US006328810B1

(12) United States Patent
Conner et al.

(10) Patent No.: US 6,328,810 B1
(45) Date of Patent: Dec. 11, 2001

(54) METHOD FOR LOCALLY REMOVING OXIDATION AND CORROSION PRODUCT FROM THE SURFACE OF TURBINE ENGINE COMPONENTS

(75) Inventors: Jeffrey A. Conner, Hamilton; Howard J. Farr, Blue Ash, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/287,627

(22) Filed: Apr. 7, 1999

(51) Int. Cl.[7] ..... B08B 7/00

(52) U.S. Cl. ..... 134/4; 134/6; 134/7; 134/2; 134/19; 134/21

(58) Field of Search ..... 134/2, 6, 4, 7, 134/19, 21, 26

(56) References Cited

U.S. PATENT DOCUMENTS

| | | | |
|---|---|---|---|
| 2,199,418 | 5/1940 | Redmond et al. | 148/8 |
| 4,162,173 | 7/1979 | Arndt et al. | 134/2 |
| 4,317,685 | 3/1982 | Ahuja et al. | 134/2 |
| 4,698,130 | 10/1987 | Restall et al. | 156/646 |
| 5,268,036 | 12/1993 | Neubauer et al. | 134/2 |
| 5,607,900 | 3/1997 | Inada et al. | 505/500 |
| 5,695,570 | 12/1997 | Douglas | 134/1.3 |
| 5,900,102 | 5/1999 | Reeves | 156/344 |
| 6,036,995 * | 3/2000 | Kircher et al. | 427/142 |

FOREIGN PATENT DOCUMENTS

| | | |
|---|---|---|
| 525545A1 | 2/1993 | (EP) . |
| 0713957A1 * | 5/1996 | (EP) . |
| 1356399 | 6/1974 | (GB) . |
| 2120278A | 11/1983 | (GB) . |
| 56033487 | 3/1981 | (JP) . |

* cited by examiner

*Primary Examiner*—Zeinab El-Arini
(74) *Attorney, Agent, or Firm*—Andrew C. Hess; David L. Narciso

(57) ABSTRACT

A method for removing products of hot corrosion and oxidation from selective portions of surfaces of a gas turbine engine, such as coatings and substrates, following exposure of the surfaces to hot oxidative gases of the turbine exhaust. The method involves a high temperature chemical reaction and has no detrimental effect on adjacent coatings and substrates that have not been attacked by the hot exhaust gases.

20 Claims, 3 Drawing Sheets

METHOD FOR LOCALLY REMOVING OXIDATION AND CORROSION PRODUCT FROM THE SURFACE OF TURBINE ENGINE COMPONENTS

BACKGROUND OF THE INVENTION

1. Field of the Invention

This invention relates to removal of local oxidation and corrosion products from portions of hardware without affecting adjacent, coated regions, and more particularly to removing local oxidation and corrosion product from airfoils removed from turbine service without affecting adjacent aluminide coatings.

2. Discussion of the Prior Art

Components such as turbine airfoils operate under strenuous environmental conditions at elevated temperatures. These components typically are coated with an aluminide as a bond coat or as an environmentally-protective coating. The harsh environment and elevated temperatures result in localized attack of the component that may penetrate the coating and work into the diffusion zone between the coating and the substrate. Repair of turbine hardware typically has involved removal of loose contamination followed by removal of tightly adherent corrosion and oxidation as the first steps in the repair process. This cleaning subjects the hardware to mechanical cleaning, such as abrasive cleaning or grit blasting, or to chemical cleaning. Chemical cleaning involves exposure of the hardware to chelating agents or immersion in high temperature caustic solutions. In order to complete the repair, the diffusion aluminide layer which was applied either as a bond coat or as an environmental coat, is removed by exposure to application of or immersion in an acid solution. Damage is then repaired, typically by welding, and a new aluminide coating is generated. The disadvantage of such methods is that the wall of the turbine hardware is affected by the cleaning and coating stripping processes since the protective aluminide coating is diffused into the original component wall and metal required to carry the load of operation is removed. Repeated stripping of the component thus typically limits the number of repair cycles that can be employed. Typically, only one stripping can be successfully accomplished due to concerns with loss of wall thickness.

While various methods exist for cleaning contaminants and oxides from the surfaces of components as part of the repair and restoration procedure, most of these methods involve subjecting the entire component to the cleaning operation, even when only a portion of the component requires cleaning and repair. One such method is set forth in U.S. Pat. No. 4,317,685 ('685 patent) to Ahuja et al. and assigned to the same assignee of the present invention. The '685 patent employs an aqueous solution of alkaline hydroxide. The component to be cleaned is placed in an autoclave with the aqueous alkaline hydroxide solution and heated to an elevated temperature in the range of 200–340° C. The solution is permitted to react with the surface scale, and the reaction product is removed from the surface by flushing and the remaining process as described above is accomplished by removal of the remaining aluminide by acid etch, repair of the affected area and subsequent realuminiding, so that the problem of wall thinning is not addressed by this process.

An alternative approach for repairing turbine airfoil components that avoids the loss of material from load bearing walls is to apply an aluminum coating over the existing coating, thereby replenishing the protective aluminum and permitting further engine exposure. The impediment to this approach is the presence of oxidation and/or corrosion products on the surface of the hardware after removal of service in the turbine engine.

Some methods exist for cleaning corrosion from localized regions of a surface, but these are generally restricted to removal of trace metal contamination from surfaces of semiconductors. These methods would have no application to turbine components from which contamination and oxides must be removed, as semiconductors are generally an oxide species. One example of such cleaning is set forth in U.S. Pat. No. 5,695,570 to Douglas, that involves applying an ambient species to the contaminated surface, followed by photostimulation to allow reaction of the trace metal contamination with the ambient species with subsequent removal of the metal products from the surface.

What is needed is a method for accomplishing the repair of a turbine airfoil component by cleaning only the localized regions of the component affected by corrosion and oxidation without detrimentally altering adjacent regions of the coating unaffected by corrosion and oxidation, followed by repair of the locally cleaned region and application of an aluminide coating to the region of local repair.

BRIEF SUMMARY OF THE INVENTION

The present invention provides a material composition used as part of a method for selectively removing products of combustion from the surfaces of gas turbine hardware following extended exposure of the surfaces to the hot oxidative and corrosive atmosphere of gas turbine exhaust without attacking unaffected, adjacent base metal or coating.

The method involves first removing loose contamination from the surfaces of the hardware requiring repair. The surfaces are then inspected to determine the portions of the hardware requiring repair. Those portions requiring repair typically have experienced damage to the protective coating surface as a result of oxidation and/or hot corrosion attack. Next, a reactive metal is applied to the preselected portions of the hardware surfaces requiring repair. The reactive metal may be applied as a slurry or as a moldable tape. The slurry is comprised of a reactive element, an inactive filler and a carrier liquid. The moldable tape is comprised of a reactive element and an inactive filler. The hardware is then heated in a nonreactive atmosphere to a first preselected temperature. This step causes a reaction between the products of combustion and/or oxidation and the applied reactive element, thereby locally breaking down the corrosion/oxidation products. The hardware is then cooled to a second preselected temperature. As used herein, the terms "products of combustion" and "combustion products" refer to damage resulting from oxidation or hot corrosion that occurs from exposure to the hot combustion gases, and is distinguished herein from "loose contamination" which refers to deposits resulting from exposure to combustion gases that are not chemically bound to the underlying surface. The by-products of the reaction between the applied materials and the corrosion/oxidation products can be easily removed. An aluminiding treatment may then be applied to the engine hardware to restore corrosion protection to those areas requiring repair as a result of oxidation and corrosion attack.

Another advantage of the present invention is that the local oxidation and corrosion product can be removed from those portions of the article that have experienced damage, with no effect on adjacent areas that have not been damaged, and these areas can be repaired.

Another advantage of the present invention is that the local oxidation and corrosion product can be removed from those portions of the article that have experienced damaged, with no effect on adjacent areas that have not been damaged, and these areas can be repaired.

Still another advantage of the present invention is that the costly operation of completely stripping all of the coating from hardware that only has localized damage and completely reapplying a protective coating can be avoided. The hardware life can be extended. Because the stripping of the protective coating is typically accomplished using a chemical process, such as by exposing the article to an acid, there is an associated reduction in the thickness of the wall of the article undergoing repair. This wall thickness reduction shortens the life of the article and limits the number of repair cycles that the article can undergo. Further, by eliminating the chemical stripping process, the cost of the chemicals and the disposal of the chemicals, now a hazardous material containing heavy metal, is eliminated.

Yet another advantage is the reduced impact on airflow control associated with the removal and reapplication of coating in film cooling holes intersecting surfaces requiring coating. Additionally, operations required to mask dovetail and internal cavities are eliminated, thereby further reducing costs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides a method for restoring protective coating to localized regions of a gas turbine engine component that have been damaged by corrosion or oxidation without affecting the substrate or adjacent regions of coatings that have not been damaged by corrosion or oxidation.

Components such as airfoils in a gas turbine engine are subject to the hot gases of combustion from the combustion process in the combustor portion of the engine. Because of the extreme environment to which they are subjected, notably the high temperatures and corrosive gases, these airfoils are given protective coatings such as aluminide or MCrAlY (X) coatings, where M is an element selected from the group consisting of Fe, Co and Ni and combinations thereof and X is an element selected from the group consisting of Ti, Ta, Re, Ru, Mo, W, B, C, Hf and Zr and combinations thereof. However, over the service life, the protective layers formed by these coatings (e.g. $Al_2O_3$ scale) can be compromised in local areas for any one of a number of reasons, such as foreign object impact, erosion or diffusion effects changing the composition of the protective layer, thereby subjecting the underlying material to attack by oxidation and corrosion. The present invention permits a restoration of a protective coating to these localized damaged areas without requiring the complete removal of all of the remaining protective coating.

The present invention utilizes a composition including a reactive element and an inactive filler, locally applied in the form of a tape or a slurry to remove oxidation and corrosion from local areas. When the reactive element composition is in the form of a slurry, it further includes an evaporable carrier liquid. The reactive element may be aluminum (Al), silicon (Si), titanium (Ti), zirconium (Zr) or any other metal having an affinity for oxygen. The inactive filler may be any material that will not affect the activity of the reactive element and will not affect the underlying substrate or adjoining protective coating. Alumina is one effective and inexpensive filler, but any other inert composition that will not affect performance may be utilized. The carrier liquid may be any suitable evaporable liquid that can be used to form a slurry with the reactive element and the inactive filler, and which will evaporate either at room temperature or at slightly elevated temperatures. Some suitable carrier liquids include glycerol, ethanol and acetone, but other carrier liquids that readily vaporize without affecting the substrate and the reactive material may also be used.

Figure 1:
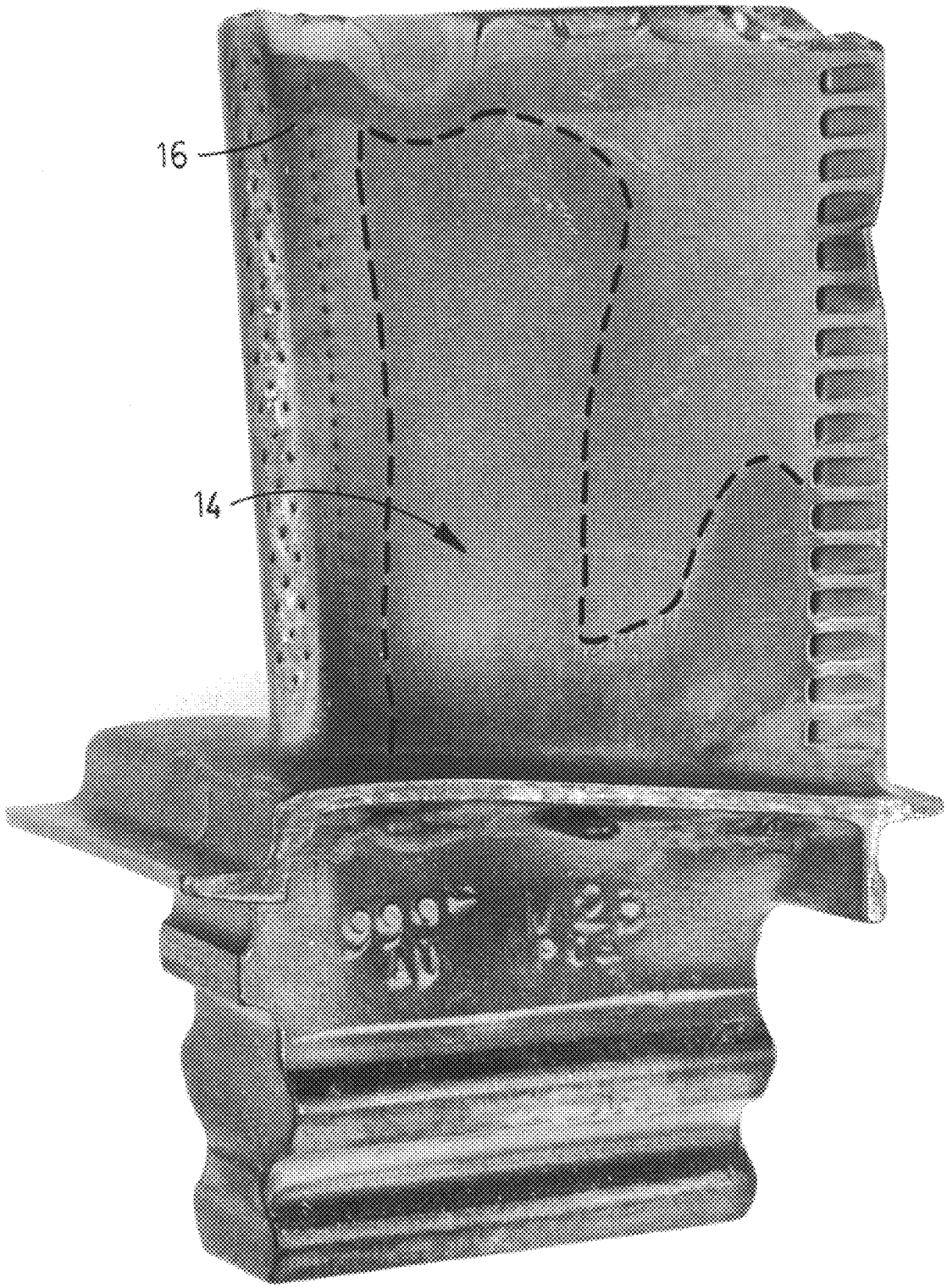
FIG. 1 is a photomicrograph from a gas turbine air airfoil removed from service from a gas turbine engine, showing localized areas of the coating and the substrate that have undergone significant corrosion/oxidation attack.

After loose contamination is removed from airfoils undergoing repair, the areas of the airfoil in which significant corrosion or oxidation attack has occurred can be readily identified. FIG. 1 is a photomicrograph of an airfoil from which loose contamination has been removed, exposing regions that have been subject to corrosion and oxidation attack. Referring to FIG. 1, a turbine blade has a localized region 14 that has undergone significant corrosion and oxidation attack, and unaffected coating 16 adjacent to region 14. A diffusion zone (not shown in FIG. 1) underlying the coating has developed as a result of growth due to diffusion processes into the original substrate. Currently available prior art processes typically require the removal of the entire coating as well as at least a portion of the diffusion zone between the coating and substrate by subjecting the entire airfoil to an acid treatment. Since the diffusion zone in the airfoil removed from service extends into what once was virgin substrate material, these prior art chemical processes reduce the wall thickness of the airfoil as diffusion zone material is removed. Because of the thin nature of the airfoil walls, it is readily apparent that an airfoil could be subjected to only one or two repair such cycles before it must be taken out of service.

Figure 2:
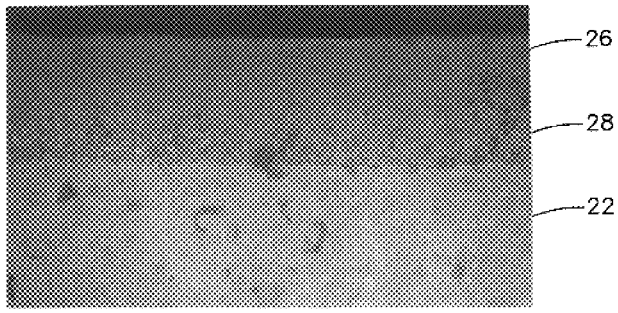
FIG. 2 is a photomicrograph at 400 magnification (400×) of an airfoil removed from service showing the baseline coating in a region unaffected by hot corrosion attack.

FIG. 2 shows a portion of an airfoil removed from service, but not subject to corrosion/oxidation attack after removal from engine service. This portion of the airfoil requires no repair as substrate 22 and coating 26 were unaffected by the severe environment of turbine operation, remaining substantially intact. A typical diffusion zone 28 develops as a result of coating and subsequent high temperature operations.

Figure 3:
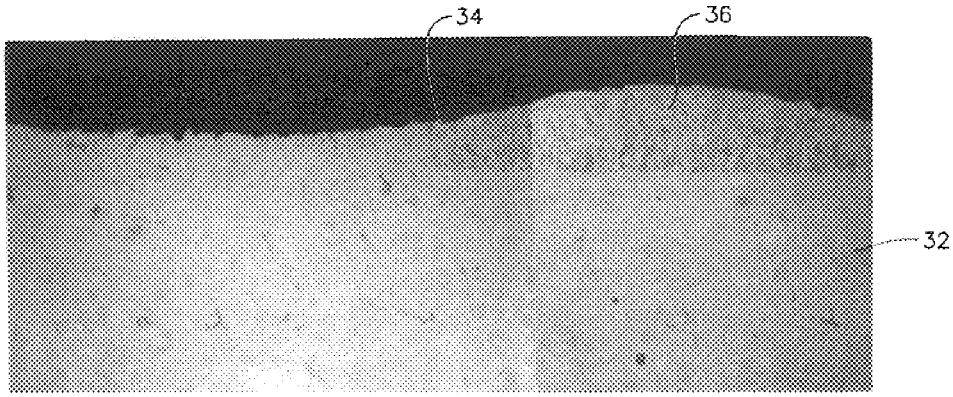
FIG. 3 is a photomicrograph of an airfoil removed from service showing the condition of the coating and the substrate of a region that has experienced significant hot corrosion attack during engine operation after processing through an elevated temperature cycle with application of the slurry of the present invention.

Referring now to FIG. 3, which is a photomicrograph of an airfoil removed from service showing the condition of the substrate region 32 and coating that has experienced significant hot corrosion attack after engine operation, such as the airfoil in FIG. 2, but which has been subjected to the processing of the present invention to remove oxidation and hot corrosion products. It will be understood that there are regions adjacent to the region shown in FIG. 3 in condition similar to FIG. 2 that are not shown and that are unaffected by corrosion. This airfoil, after removal of loose contamination products, was treated in accordance with the present invention. An aluminum-containing slurry that included a composition comprised of about 56.5% by weight of aluminum and the balance iron and incidental impurities was prepared by mixing the composition with an inert filler, alumina, and a carrier liquid and applied to the corroded areas or regions. The slurry was allowed to air dry, by natural evaporation of the carrier liquid. The airfoil was then placed in a furnace and heated to a temperature of about 1925° F. Although this temperature was used for this slurry, any temperature which promotes the following reaction may be used:

$$3M(AlO_2)_2+4Al \rightarrow MAl_2+2Al_2O_3 \quad (1)$$

where M=Ni, Co or mixtures thereof, as is typically found in superalloy substrate base materials. While the Ni or Co of the base material may form $MAl_2$, this is not necessary, since the key to the operation is the removal of the oxygen from the substrate. Thus, the reaction of the Al with the oxide attached to the substrate to form the $2Al_2O_3$ is critical to the success of the operation. Since this reaction occurs at elevated temperatures, the airfoil containing the composition of the present invention should be heated in the range of 1800–2000° F in hydrogen or inert atmosphere. Alternatively, the airfoil may be heated in a vacuum.

After heating, the airfoil is cooled to ambient temperature. As shown in FIG. 3, the darkened region 34 indicates locations in which material subject to corrosion/oxidation attack 34 has been removed, leaving some unaffected regions of diffusion zone 36. Any remaining oxidation/corrosion by-product may be removed by light mechanical processing, such as by brushing or very light grit blasting.

Figure 4:
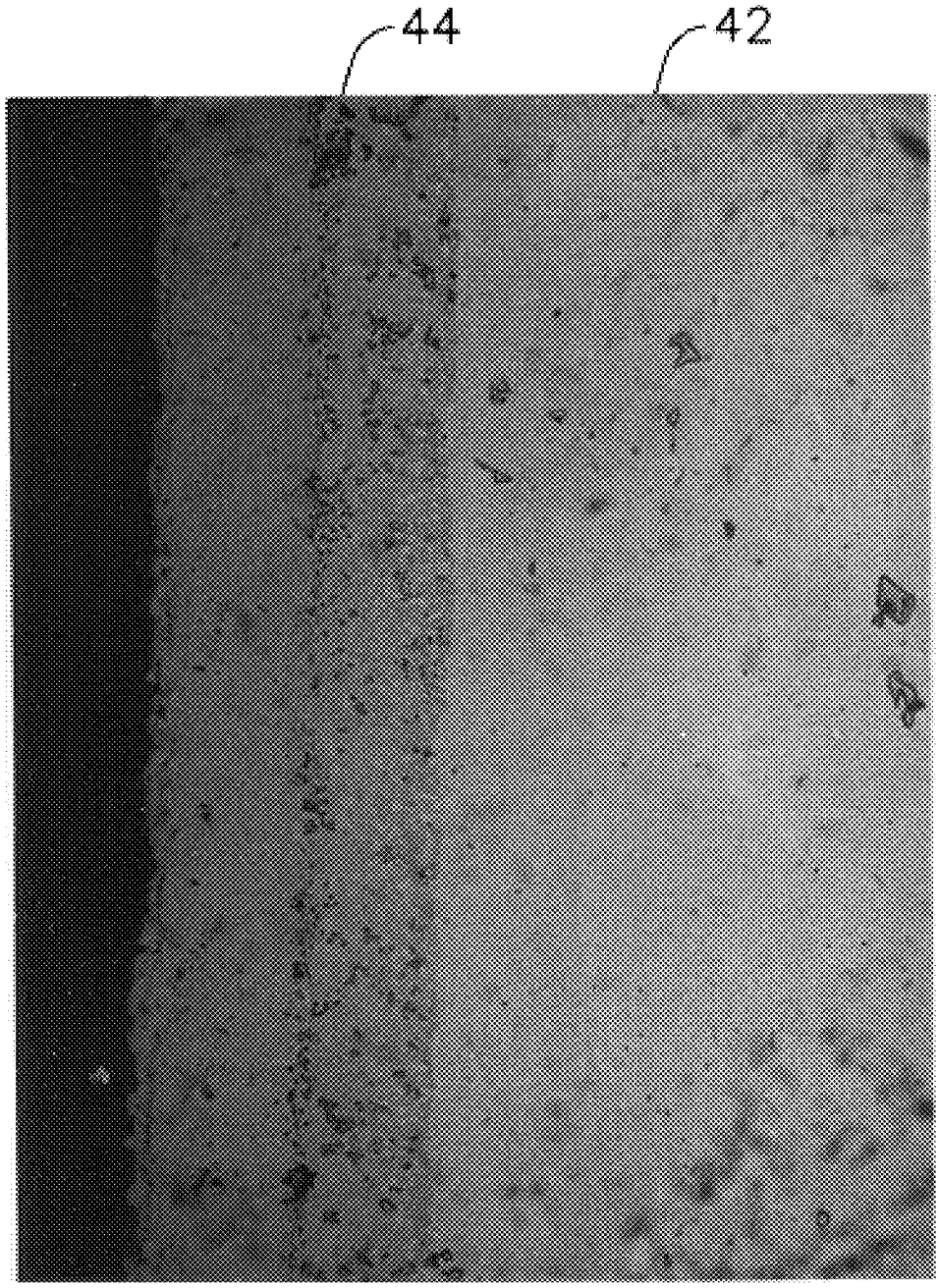
FIG. 4 is a photomicrograph of an airfoil removed from service showing the condition of the coating and the substrate of a region that has experienced significant hot corrosion attack during engine operation after the processing depicted in FIG. 3 and recoating.

Referring now to FIG. 4, the airfoil has its protective coating locally restored by subjecting the blade to a localized coating process. In this particular case, the coating 44 was restored over substrate 42 by applying the aluminum-containing slurry locally over the area that requires repair and heating the slurry-coated airfoil at an elevated temperature of 1925° F., although any temperature in the range of 1800–2000° F. would be effective to promote the reaction set forth in equation 1. The repaired article of FIG. 4 was the result of this repair procedure. While the coating was restored to the region from which the oxidation/corrosion was removed using an aluminum-containing slurry, any other acceptable method for restoring the protective coating to the airfoil may be used. Other coating restoration processes are set forth in patent application Ser. No. 09/219,162, now U.S. Pat. No. 6,203,847 and Ser. No. 09/219,163, now U.S. Pat. No. 6,042,880, both filed Dec. 22, 1998 and assigned to the assignee of the present invention and are incorporated herein by reference. Alternatively, the entire airfoil may be subject to a conventional aluminiding treatment. The areas of the airfoil from which the corrosion/oxidation products have been removed by the repair process described above will preferentially be affected by the aluminiding treatment. The standard aluminiding treatment may slightly affect the adjacent areas of the coating, causing a slight change in coating thickness, but this is not an undesirable result. Because the aluminum concentration in these coated areas is already high, the driving force for further diffusion of Al into these regions will be slow and the increased thickness will be slight.

While the example set forth above has been described in terms of locally restoring aluminides and MCrAlY coatings when these coatings are used as protective environmental coatings, the processes and materials of the present invention can be used to locally restore these coatings when used as intermediate bond coats. However, when the materials and processes of the present invention are used to restore such intermediate bond coats, two additional steps are required. The thermal barrier coating ("TBC") must first be removed by a process that leaves the bond coat intact, allowing removal of oxidation/corrosion product present in regions where TBC spalled during engine service.

Once the oxidation/corrosion product has been removed, the bond coat can then be restored and the TBC re-applied.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A method for selectively removing products of combustion from surfaces of gas turbine engine hardware comprised of superalloy material, the method comprising the steps of:

removing loose contamination from hardware surfaces;

selectively applying a reactive metal composition comprising a reactive metal and an inactive filler to a preselected portion of the hardware surfaces; then heating the hardware in a nonreactive atmosphere to a first preselected temperature to cause a reaction between the products of combustion and the reactive metal, thereby breaking down the combustion products in the preselected portion of the hardware surface; and cooling the hardware to a second preselected temperature.

2. The method of claim 1 wherein the reactive metal includes a reactive metal having an affinity for oxygen.

3. The method of claim 2 wherein the reactive metal having an affinity for oxygen includes at least one metal selected from the group consisting of aluminum, silicon, titanium and zirconium.

4. The method of claim 2 wherein the step of applying a reactive metal composition includes applying a slurry of the reactive metal having an affinity for oxygen, the inactive filler and an evaporable liquid carrier.

5. The method of claim 4 wherein the reactive metal having an affinity for oxygen includes at least one metal selected from the group consisting of aluminum, silicon, titanium and zirconium, the inactive filler is alumina and the evaporable liquid carrier is selected from the group consisting of glycerol, ethanol and acetone.

6. The method of claim 2 wherein the composition that includes the reactive metal having an affinity for oxygen is comprised of about 50–60% aluminum and the balance iron and impurities.

7. The method of claim 1 in which the step of heating the hardware in a nonreactive atmosphere includes heating the hardware to a first preselected temperature in a range of about 1800–2000° F.

8. The method of claim 7 wherein the temperature is about 1925–1950° F.

9. The method of claim 1 wherein the step of heating the hardware in a nonreactive atmosphere includes heating the hardware in an atmosphere selected from the group consisting of an inert gas, hydrogen and a vacuum.

10. The method of claim 1 wherein the step of applying a reactive metal composition includes applying a tape that includes the reactive metal and the inactive filler.

11. The method of claim 10 wherein the reactive metal includes at least one metal selected from the group consisting of aluminum, silicon, titanium and zirconium and the inactive filler is alumina.

12. The method of claim 1 further including a step of applying an aluminiding treatment to the surface of the engine hardware after the step of cooling the hardware to a second preselected temperature.

13. The method of claim 1 wherein the reaction between the products of combustion and the reactive metal forms a protective coating and by-products on the preselected portions of the hardware surface and further comprising the step of removing by-products of the reaction from the preselected portions of the hardware surface.

14. A method for restoring environmental protection to portions of an airfoil by selectively removing oxidation and corrosion from gas turbine airfoil surfaces, the airfoils comprised of superalloy material, the method comprising the steps of:

removing any preapplied ceramic thermal barrier coatings from the airfoil surfaces;

removing loose contamination from airfoil surfaces;

selectively applying a reactive metal composition comprising a reactive metal and an inactive filler to a preselected portion of the airfoil surfaces affected by oxidation and corrosion; then heating the airfoil in a nonreactive atmosphere to a first preselected temperature to cause a reaction between the oxidation and corrosion and the reactive metal, thereby causing a reaction with oxides to remove oxygen in the preselected portion of the airfoil surface and restoring a protective coating to the preselected portion of the airfoil.

15. The method of claim 14 wherein the reactive metal composition includes a reactive metal having an affinity for oxygen.

16. The method of claim 15 wherein the reactive metal is selected from the group consisting of aluminum, silicon, titanium and zirconium.

17. The method of claim 14 wherein the step of heating the airfoil in a nonreactive atmosphere to a first preselected temperature includes heating the airfoil in an inert gas atmosphere to a temperature in a range of 1800–2000° F.

18. The method of claim 14 further comprising, after the step of heating the airfoil, the steps of:

cooling the airfoil to ambient temperature;

removing by-products formed from the reaction between the reactive metal and the oxidation and corrosion from the preselected portions of the airfoil surface; and applying an aluminiding treatment to the surface of the airfoil.

19. The method of claim 14 wherein the step of heating the airfoil in a nonreactive atmosphere includes heating the airfoil in an atmosphere selected from the group consisting of an inert gas, hydrogen and a vacuum.

20. A method for restoring environmental protection to portions of an airfoil by selectively removing oxidation and corrosion from gas turbine airfoil surfaces, comprising:

removing any preapplied ceramic thermal barrier coatings from the airfoil surfaces;

removing loose contamination from airfoil surfaces;

applying a reactive metal slurry that is comprised of aluminum as a reactive element, alumina as an inactive filler and ethanol as an evaporable carrier liquid to a preselected portion of the airfoil surfaces affected by oxidation and corrosion; then heating the airfoil in an inert gas atmosphere to a temperature of about 1925° F. to cause a reaction between the oxidation and corrosion and the reactive metal, thereby breaking down the oxidation and corrosion in the preselected portion of the airfoil surface into by-products, so that the airfoil surface can be exposed to a subsequent treatment;

cooling the airfoil to ambient temperature;

removing the by-products from the airfoil surface; and applying an aluminiding treatment to the surface of the airfoil.

* * * * *